US006331270B1

(12) United States Patent
Lefebvre et al.

(10) Patent No.: US 6,331,270 B1
(45) Date of Patent: Dec. 18, 2001

(54) MANUFACTURING SOFT MAGNETIC COMPONENTS USING A FERROUS POWDER AND A LUBRICANT

(75) Inventors: Louis-Philippe Lefebvre, Montréal; Sylvain Pelletier, Ste-Julie; Yannig Thomas, Montréal, all of (CA)

(73) Assignee: National Research Council of Canada, Ottawa (CA)

( * ) Notice: Subject to any disclaimer, the term of this patent is extended or adjusted under 35 U.S.C. 154(b) by 0 days.

(21) Appl. No.: 09/322,178

(22) Filed: May 28, 1999

(51) Int. Cl.[7] ..... B22F 3/12; B22F 3/26
(52) U.S. Cl. ..... 419/27; 419/38; 75/246
(58) Field of Search ..... 419/38, 27; 75/246

(56) References Cited

U.S. PATENT DOCUMENTS 4,721,599 * 1/1988 Nakamura ..... 419/23
5,993,729 * 11/1999 Lefebvre et al. ..... 419/2

FOREIGN PATENT DOCUMENTS 1-129903 * 5/1989 (JP) .

* cited by examiner

*Primary Examiner*—Daniel J. Jenkins

(57) ABSTRACT

Near-net-shape soft magnetic components can be produced from iron powder lubricant compositions using powder metallurgy techniques. The resulting components have isotropic magnetic and thermal properties and may be shaped into complex geometry using conventional compaction techniques. A non-coated ferromagnetic powder is mixed with a lubricant and compacted. After compaction, the components are thermally treated at a moderate temperature to burn out the lubricant, relieve the stresses induced during pressing and reduce the hysteresis losses. Depending on the application, the properties of the material may be tailored by varying the content and type of the lubricant and the thermal treatment conditions.

13 Claims, No Drawings

MANUFACTURING SOFT MAGNETIC COMPONENTS USING A FERROUS POWDER AND A LUBRICANT

FIELD OF THE INVENTION

This invention relates to a process for manufacturing soft magnetic components using a ferrous powder and a lubricant, and to compositions produced by the process.

BACKGROUND OF THE INVENTION

Steel laminations have been used for decades in low frequency magnetic components. The design of stacked magnetic components must take into account that the magnetic flux is confined in planes parallel to the sheet surfaces. Additionally, there are difficulties with miniaturisation and waste material with steel laminations, which can be important for some type of electric motors.

The idea to use iron powder in magnetic components was first introduced by Fritts and Heaviside in the 1880's. Since the beginning of the century, iron powder has been used for the production of magnetic components (iron powder cores were introduced in the U.S. to replace wire cores around 1915). Powder metallurgy offers the possibility of controlling the spatial distribution of the magnetic flux and allows practically full utilization of materials even for the manufacture of complicated shapes. Recent advances in powder metallurgy offer new opportunities in the design of electromagnetic components. Several authors have shown the advantages to use iron/resin composites especially for applications in the medium and high frequency ranges.

When a magnetic material is exposed to an alternating magnetic field, it dissipates energy. The power dissipated under an alternating field is defined as core losses. The core losses are mainly composed of hysteresis and eddy current losses. Hysteresis losses are due to the energy dissipated by the domain wall movement. The hysteresis losses are proportional to the frequency and are mainly influenced by the chemical composition and the structure of the material.

Eddy currents are induced when a magnetic material is exposed to an alternating magnetic field. These currents lead to an energy loss through Joule (resistance) heating. Eddy current losses are expected to vary with the square of the frequency, and inversely with the resistivity. The relative importance of the eddy current losses thus depends on the electrical resistivity of the material.

Sintered iron powder components are currently used to make parts for DC magnetic applications. However, sintered parts have low resistivity and are generally not used in AC applications. For applications in alternating magnetic field (AC), a minimal threshold resistivity is required and powder mixes containing insulating resins are generally used. The resin is used to insulate and bind the magnetic particles together. It is well known that iron-resin composites have very low eddy current losses and perform well at moderate and high frequency, while eddy current losses are important at those frequencies in stack assemblies. However, at low frequencies, e.g., 60 Hz, the eddy current portion of the losses is not as important in stack assemblies and the performance of the iron-resin composites is limited by their hysteresis losses. In fact, the hysteresis portion of the losses is higher in iron-resin composite than in stack assemblies. During the fabrication of soft magnetic components with iron powders, stresses are induced in the material. These stresses significantly increase the hysteresis portion of the losses. These stresses can be relaxed by heating the component at high temperature. However, the resin generally used in iron-resin composites cannot withstand the temperature used to relax the stresses. After the thermal treatment, the parts generally do not have sufficient mechanical strength and electrical resistivity for many applications.

Powder formulations for the fabrication of annealed soft magnetic components for AC soft magnetic applications have been described in patent literature.

U.S. Pat. No. 5,595,609 issued Jan. 21, 1997 to Gay discloses polymer-bonded soft magnetic body that can be annealed at temperature around 500° C. The magnetic powder used is encapsulated with a thermoplastic coating selected from the group of polybenzimidazole and polyimides having heat deflection temperatures of at least about 400° C.

U.S. Pat. No. 5,754,936 issued May 19, 1998 to Jansson, and WO 95/29490 disclose phosphate coated powders that can be used for the fabrication of annealed components. After compaction, the components are treated at temperature ranging from 350 to 500° C. to stress relief the magnetic powders.

U.S. Pat. No. 5,352,522 issued Oct. 4, 1994 to Kugimiya et al. discloses oxide coated powders that can be processed at high temperature (800° C.) for the fabrication of soft magnetic components.

European patent application EPO 088 992 A2 discloses oxide coated powders for the fabrication of magnetic components processed at high temperatures (900° C.).

U.S. Pat. No. 4,601,765 issued Jul. 22, 1986 to Soileau et al. discloses silicate coatings for the fabrication of annealed components.

F. Hanejko et al. "Application of High Performance Material Processing Electromagnetic Products" in the Proceedings of the 1998 International Conference on Powder Metallurgy & Particulate Materials, May 31–June 4th, Las Vegas, Nev., 1998, p. 8–13. presented results on annealed soft magnetic components fabricated with coated powders.

The above-discussed prior art discloses coated powders for the fabrication of annealed soft magnetic components for AC soft magnetic applications. Coating the powder represents an additional step during the preparation of the material. It involves additional cost and the preparation of the powder may require additional equipment. None of the prior art discloses compositions produced with uncoated powders. In addition, in most of the prior art processes, the composition does not contain an admixed lubricant and cannot be processed using simple compaction at room temperature without using die wall lubrication.

Other references of interest are: R. W. Ward and D. E. Gay, "Composite Iron Material", U.S. Pat. No. 5,211,896 (1993); H. Rutz and F. G. Hanejko, "Doubly-Coated Iron Particles", U.S. Pat. No. 5,063,011 (1991); G.Katz, "Powdered Iron Magnetic Core Materials", U.S. Pat. No. 2,783,208 (1957); and P. N. Roseby, "Magnet Core", U.S. Pat. No. 1,789,477 (1931). This prior art does not refer to thermal treated materials having reduced hysteresis losses.

Mixes (compositions) composed of iron powder and lubricant have been used for a long time for powder metallurgy applications. The lubricant is used to ease the compaction of the powder, ease the ejection of the part from the die and to minimize die wear. After compaction, the part does not have sufficient mechanical properties and must be sintered to create metallurgical bonds between the particles. Sintering is generally done at temperature ranging from 1000° C. up to 1200° C. Specimens compacted from iron-lubricant mixtures cannot be used in the green (non-heated)

nor the sintered state for the fabrication of components for AC soft magnetic applications, having low core losses. The green parts do not have sufficient mechanical strength while the sintered components do not have sufficient electrical resistivity to maintain low eddy current losses.

It is an object of the present invention to provide powder compositions and a process for the fabrication of soft magnetic components intended for low frequency soft magnetic applications.

It is a further object of this invention to increase the mechanical strength of the components without sintering.

SUMMARY OF THE INVENTION

It has been found that non-coated iron powder admixed with a lubricant can be used for the fabrication of soft magnetic components having low core losses at low frequency. According to the invention, the non-coated powder is mixed with a solid lubricant. After compaction, the specimens are heated at a moderate temperature, below the level corresponding to full sintering. The thermal treatment relieves the internal stresses induced during the compaction. The thermal treatment also removes, to a large degree, the lubricant. Bonds between the powder particles, which may have a positive effect on the mechanical strength of the material, may also be created during the thermal treatment. If the material does not have sufficient mechanical strength after the thermal treatment, the material may be impregnated with a resin to further increase the mechanical strength.

The soft magnetic powder is not coated before mixing with the lubricant. The non-coated powder is admixed with a lubricant. The lubricant prevents the formation of interparticle contacts during compaction and may leave residues after delubrication, which may increase the electrical resistivity of the material. The powder is compacted using conventional powder metallurgy techniques. Since the powder contains an admixed lubricant, the powder can be shaped without using die wall lubrication. The properties of the material may be adjusted by modifying the lubricant type and content and the thermal treatment conditions. The processing conditions described in the present application allow obtaining material with low core losses at low frequency.

The powder composition comprises a ferromagnetic powders, such as pure iron or iron alloy powder. The typical average particle size of the starting powder can range from 5 $\mu$m to 1 mm, but preferably below 250 $\mu$m or 60 US mesh. In the tests conducted to validate the invention, the powder used was ATOMET™ 1001 HP water-atomized iron powder designed for soft magnetic P/M applications available from Quebec Metal Powders Limited, Tracy, Quebec, Canada.

The ferromagnetic powder is admixed with a lubricant. The admixed lubricant reduces the friction between the compacts and die walls and minimize die wear during compaction of the component. The lubricant prevents the formation of interparticle electrical contacts during compaction and increases significantly the electrical resistivity of the green (as-pressed) material. The lubricant may be any lubricant known for powder metallurgy applications. The lubricant may be, for example, selected from synthetic waxes, amide-based waxes, metallic stearates, polymeric lubricants, fatty acids, boric acid or borate esters. The lubricant may be dry-mixed with the powder, or it may be melted or dissolved for admixing. The lubricant may also be bonded to the iron based powder with a binder. The choice of the lubricant will mainly depend on the required properties of the material. Some lubricants provide parts with higher electrical resistivity after the thermal treatment, while other lubricants provide parts with higher permeability or higher mechanical strength. The amount of lubricant also depends on the required properties of the final material. Increasing the amount of lubricant improves the electrical resistivity after thermal treatment, but lowers the permeability. The amount of lubricant should be typically between 0.25 wt % and 4 wt %, but preferably between 0.75 wt % and 2.5 wt % of the powder-lubricant mixture.

The powder is compacted or molded into the desired component or shape. Generally, the method used to consolidate metal powders into integral components consists of filling the die with the powder and pressing the powder at the appropriate pressure and temperature. Pressing the parts at higher pressure and temperature increases the density and consequently the permeability. However, increasing the compacting pressure and temperature reduces by the same way the electrical resistivity of the compacts and consequently increases the eddy currents in the parts as frequency increases.

After compaction, the specimens undergo a thermal treatment at a moderate temperature. The thermal treatment is carried out to burn out the lubricant and to stress relief the parts. Thermal oxidation bonding between the ferromagnetic particles may occur during the thermal treatment. Lubricant decomposition products may also form interparticular bonds during the thermal treatment and increase the mechanical strength.

In order to maintain sufficient electrical resistivity and to stress relief the components, the thermal treatment should be effected at temperatures ranging from 400° C. to 700° C., but preferably between 450° C. and 650° C. The temperature should be selected such as to avoid sintering of the powder at least to a substantial degree. The thermal treatment duration may vary from 1 min up to 6 hours but preferably between 1 and 30 min. The thermal treatment conditions are generally chosen to optimize the magnetic properties of the component. Increasing thermal treatment temperature and duration generally lowers the electrical resistivity and the hysteresis portion of the losses. By optimizing the thermal treatment conditions, it is possible to reduce the total core losses.

If the mechanical strength of the treated components is not sufficient, the components may be impregnated to increase their mechanical strength. The impregnation should be carried out after the thermal treatment. The impregnant can be selected from the group consisting of thermosetting and thermoplastic resins, low-melting point inorganic insulators or the precursors of the latter. The only limitation on the choice of the impregnant, which must of course be electroinsulative, is its ability to flow around each ferromagnetic particles and pores and increase the mechanical strength of the parts. The impregnant can be melted or dissolved in a compatible solvent prior to the impregnation. The impregnation can be done at room temperature or with heating and under atmospheric pressure. The impregnation can also be done under pressure optionally with heating to make the impregnation easier. Depending on the type of binder used, a heat treatment or curing can be done after the impregnation.

A particularly interesting feature of the present invention is that the powder can be shaped at room temperature using conventional powder metallurgy techniques. The powder can be shaped without die wall lubrication, since the powder mix contains an admixed lubricant. The formulation is easy to prepare since the powder does not have to be coated with an inorganic insulative coating prior to compaction. Parts fabricated according to the methods described above have sufficient electrical resistivity and low core losses at 60 Hz. The parts also present mechanical strength sufficient for many soft magnetic applications.

EXAMPLES

A high purity, water-atomized iron powder ATOMET 1001HP supplied by Quebec Metal Powders Ltd. (Tracy, Quebec, Canada) was used in these examples. In addition to the examples supporting the invention, results of comparative examples, with specimens fabricated with iron-resin composite and sintered iron components, are given in Table 1. The iron-resin composite was fabricated by admixing the iron powder with 0.8 wt % thermoset resin. The specimen was compacted at 45 tsi/25° C. and cured 1 h at 175° C.

Example 1

A high purity water-atomized iron powder, screened out to leave a powder with particles between 75 μm and 250 μm (−60 +200 mesh), was used in these experiments. The powder was dry mixed with 1 to 2.5 wt % zinc stearate (provided by H. L.

Blachford Ltd., Montreal, Quebec, Canada) in a V-type blender for 30 minutes.

Rectangular bars (3.175×1.27×0.635 cm) and rings (OD=5.26 cm, ID=4.34 cm, h=0.635 cm) were pressed at 620 MPa (45 tsi) in a double action floating die at room temperature. After compaction, the specimens were heated in a tube furnace at 600° C. in argon for 5 minutes. The heating and cooling rates were 10° C./min and 5 ° C./min respectively. After cooling to room temperature the thermal-treated specimens were impregnated under vacuum with an epoxy resin to increase their mechanical strength.

After impregnation, the specimens were cured at 75° C. to cross-link the resin. Three bars and three rings were prepared for each experimental condition.

Electrical resistivity was measured on the rectangular bars using a four-point contact probe (0.8 cm between contact points) and a micro-ohmmeter (PM450 manufactured by UltraOptec, Boucherville, Quebec, Canada) adapted for this application. Five readings were taken on the top and bottom faces of each bar and averaged. Side and thickness effects were taken into account in the electrical resistivity calculations. The magnetic properties were evaluated at 60 Hz on the rings.

The effect of the lubricant content on the electric and magnetic properties is presented in Table 1. This Table shows that the electrical resistivity increases when the lubricant content increases. The electrical resistivity is significantly higher than the electrical resistivity of sintered iron (0.15 μΩ−m) and may be sufficient for AC soft magnetic applications at 60 Hz. In fact, Table 1 shows that core losses of the materials are similar or lower than those in iron-resin composites. The lower core losses of the iron-lubricant mixes are associated to the effect of the thermal treatment after compaction. During the thermal treatment, the stresses induced during compaction are partly relieved. The core losses are reduced when the lubricant content increases due to a reduction of the eddy current losses when the lubricant content increases.

The core losses of the specimen fabricated with 2.5 wt % lubricant are 63% of those of iron-resin composites cured at 175° C. and 13% of those of sintered iron. During sintering, good electrical contacts are created between the iron particles and the electrical resistivity is not sufficient to minimize the core losses in the material.

TABLE 1

Effect of the lubricant content on the electrical resistivity and core losses of specimens compacted at 45 tsi/25° C. and treated 5 min at 600° in argon.

| % lubricant (wt %) | Electrical resistivity (μΩ-m) | Core losses @ 1T/60 Hz (W/kg) |
|---|---|---|
| 1.00 | 1.6 | 11.0 |
| 1.50 | 2.5 | 8.7 |
| 2.00 | 3.5 | 8.0 |
| 2.50 | 5.5 | 7.3 |
| | Comparative example | |
| Iron-0.8 wt % resin | 200 | 11 |
| Sintered iron | 0.15 | 55 |

Example 2

This example presents the effect of different lubricants on the electric, magnetic and mechanical properties of specimens intended for soft magnetic applications. A high purity water-atomized iron powder, screened out to leave a powder with particles between 75 μm and 250 μm (−60 +200 mesh), was used in these experiments. The powder was dry mixed with 1 wt % of a lubricant (supplied by Blachford Ltd) in a V-type blender for 30 minutes. Table 2 presents the effect of different lubricants on the electrical resistivity of iron−1 wt % lubricant mixes compacted at 45 tsi/65° C. and treated 17 min at 500° C. in argon. As shown in Table 2, a number of lubricants can be used for the fabrication of soft magnetic components. The electrical resistivity depends on the lubricant. After the thermal treatment, all specimens exhibit lower core losses than iron-resin composites cured at lower temperature (see comparative example in Table 1). The lower core losses are associated with the stress relief during the thermal treatment and with the high electrical resistivity of the material.

The mechanical strength of the treated specimens depends on the lubricant. The highest mechanical strength was obtained with Caplube J™ (the chemical name of this lubricant is not available). The mechanical strength of the specimens fabricated with this lubricant is sufficiently high for many applications. For applications requiring higher mechanical strength, the specimens may be resin impregnated. Impregnation does increase the mechanical strength to values higher than 16,000 psi. The mechanical strength after impregnation also depends on the lubricant. The highest mechanical properties after impregnation were obtained with the magnesium stearate lubricant.

TABLE 2

Effect of different lubricant on the electrical resistivity and core losses of specimens compacted at 45 tsi/65° C. and treated 17 min at 500° C. in argon.

| | Mn stearate | Mg stearate | Li stearate | Zn stearate | Ferrolube M ™ | Caplube J ™ |
|---|---|---|---|---|---|---|
| Electrical resistivity (μΩ-m) | 3.36 | 3.78 | 4.37 | 3.53 | 3.19 | 13.0 |

TABLE 2-continued

Effect of different lubricant on the electrical resistivity and core losses of specimens compacted at 45 tsi/65° C. and treated 17 min at 500° C. in argon.

| | Mn stearate | Mg stearate | Li stearate | Zn stearate | Ferrolube M ™ | Caplube J ™ |
|---|---|---|---|---|---|---|
| Core losses (60 Hz/1T) | 9.7 | 8.3 | 8.3 | 9.06 | 10.0 | 8.0 |
| TRS (psi) | 3017 | 2384 | 2049 | 2684 | 11142 | 10497 |
| TRS after resin impregnation (psi) | 21093 | 24605 | 19116 | 21303 | 16279 | 17844 |

Example 3

A high purity water-atomized iron powder, screened out to leave a powder with particles between 75 μm and 590 μm (−30 +200 mesh), was used in these experiments. The powder was dry mixed with 0.75 wt % zinc stearate in a V-type blender for 30 minutes. The specimens were compacted at 45 tsi/65° C. and treated 30 min in nitrogen at different temperatures.

Table 3 presents the effect of the thermal treatment temperature on the electric and magnetic properties of the resulting specimens. The thermal treatment allows reducing the coercive force even at 450° C. In fact, the coercive force is 314 A/m after the thermal treatment at 450° C., while it is around 420 A/m for iron-resin specimens cured at lower temperature. The reduction of the coercive force is even more important when the thermal treatment temperature increases. The reduction of the coercive force during the thermal treatment lead to a reduction of the hysteresis portion of the total losses. When the specimens are treated at higher temperature, the resistivity of the specimens decreases and this lead to an increase of the eddy current losses and total core losses as indicated in Table 3.

Table 3: Effect of the thermal treatment temperature on the electrical resistivity, coercive force and core losses of specimens fabricated with iron–0.75 wt % zinc stearate compacted at 45 tsi/65° C. After compaction, the specimens were thermally treated at 450,500 and 550° C. for 30 min in $N_2$.

| Thermal treatment ° T. | Electrical resistivity (μΩ-m) | $H_c$ @ B = 150 Oe (A/m) | Core losses @ 1T/60 Hz (W/kg) |
|---|---|---|---|
| 450° C. | 9.00 | 314 | 9.0 |
| 500° C. | 4.00 | 270 | 10.0 |
| 550° C. | 2.00 | 252 | 11.4 |
| Iron-resin composite | 200 | 420 | 11 |

What is claimed is:

1. A process for manufacturing an AC soft magnetic element from a ferromagnetic powder, comprising a) mixing a non-coated ferromagnetic powder with a lubricant suitable for powder metallurgy purposes, b) compacting the mixture of a), c) heating the compacted mixture of b) at a temperature below sintering temperature of the powder in conditions effective to reduce compaction stress of the mixture, to remove at least part of said lubricant and to bring the magnetic properties of said mixture to a level suitable for AC soft magnetic components.

2. The process of claim 1 wherein said powder is an iron powder or iron alloy powder.

3. The process of claim 2 wherein the content of said lubricant is from 0.25 wt. % to 4 wt. % based on the weight of the mixture of step a).

4. The process of claim 3 wherein the content of said lubricant is from about 0.75 wt % to about 2.5 wt. % based on the mixture of step a).

5. The process of claim 1 wherein said lubricant is selected from the group consisting of synthetic waxes, amide-based waxes, metallic stearates, polymeric lubricants, fatty acids, boric acid and borate esters.

6. The process of claim 1 wherein the temperature of the heating step c) is from 400° C. to 700° C.

7. The process of claim 6 wherein the temperature is from 450 to 650° C.

8. The process of claim 1 further comprising the step of d) impregnating the mixture of c) with an electroinsulating substance effective to increase the mechanical strength of said mixture of step c).

9. The process of claim 8 wherein the impregnating step is carried out following a cooling of the mixture of step c) to a temperature below the level corresponding to thermal decomposition of the electroinsulating substance.

10. The process of claim 8 wherein the substance is selected from a group consisting of thermosetting resins, thermoplastic resins, low-melting inorganic insulators and the precursors of low-melting inorganic insulators.

11. An AC soft magnetic element obtained by the process of claim 1.

12. An AC soft magnetic element obtained by the process of claim 5.

13. An AC soft magnetic element obtained by the process of claim 8.

* * * * *